US010066886B2

(12) United States Patent
Vilardi et al.

(10) Patent No.: US 10,066,886 B2
(45) Date of Patent: Sep. 4, 2018

(54) HYBRID MAGAZINE FOR A FIREARM

(71) Applicant: Lancer Systems L.P., Quakertown, PA (US)

(72) Inventors: Scott Lyndsley Vilardi, Alburtis, PA (US); Kasimere McManus, Quakertown, PA (US); Matthew Pettit, Breinigsville, PA (US)

(73) Assignee: Lancer Systems L.P., Quakertown, PA (US)

( * ) Notice: Subject to any disclaimer, the term of this patent is extended or adjusted under 35 U.S.C. 154(b) by 163 days.

(21) Appl. No.: 14/408,456

(22) PCT Filed: Dec. 19, 2013

(86) PCT No.: PCT/US2013/076376

§ 371 (c)(1),
(2) Date: Dec. 16, 2014

(87) PCT Pub. No.: WO2015/094255

PCT Pub. Date: Jun. 25, 2015

(65) Prior Publication Data

US 2016/0282071 A1 Sep. 29, 2016

(51) Int. Cl.

| | |
|---|---|
| ***F41A 9/61*** | (2006.01) |
| ***F41A 9/70*** | (2006.01) |
| ***F41A 9/65*** | (2006.01) |
| ***F41A 9/69*** | (2006.01) |

(52) U.S. Cl.
CPC ..... *F41A 9/70* (2013.01); *F41A 9/65* (2013.01); *F41A 9/69* (2013.01)

(58) Field of Classification Search
CPC ..... F41A 9/65; F41A 9/70; F41A 9/71
See application file for complete search history.

(56) References Cited

U.S. PATENT DOCUMENTS

| | | | | |
|---|---|---|---|---|
| 3,383,790 | A * | 5/1968 | Into | F41A 9/65 42/50 |
| 3,732,643 | A * | 5/1973 | Wells | F41A 17/38 42/50 |
| 4,391,055 | A * | 7/1983 | Kadim | F41A 9/65 42/50 |
| 8,028,455 | B1 * | 10/2011 | Battaglia | F41A 9/71 42/49.02 |
| 2010/0281737 | A1 * | 11/2010 | Cahill | F41A 9/65 42/50 |

(Continued)

FOREIGN PATENT DOCUMENTS

DE 102006011278 A1 9/2007

OTHER PUBLICATIONS

Definition of "Embed". American Heritage® Dictionary of the English Language, Fifth Edition. Copyright © 2016 by Houghton Mifflin Harcourt Publishing Company. Published by Houghton Mifflin Harcourt Publishing Company.*

(Continued)

*Primary Examiner* — Gabriel J. Klein
(74) *Attorney, Agent, or Firm* — Design IP

(57) ABSTRACT

The present application teaches a magazine (10) for a firearm. In one embodiment, the magazine includes a polymeric housing (32) including an embedded metal support guard (81) and an external metal feed lip assembly (60).

12 Claims, 7 Drawing Sheets

(56) References Cited

U.S. PATENT DOCUMENTS

| | | | | |
|---|---|---|---|---|
| 2011/0094137 | A1* | 4/2011 | Fluhr | F41A 9/65<br>42/50 |
| 2012/0233899 | A1* | 9/2012 | Daniel | F41A 9/65<br>42/49.01 |
| 2012/0255209 | A1* | 10/2012 | Klassen | F41A 9/71<br>42/6 |
| 2013/0086834 | A1 | 4/2013 | Battaglia | |
| 2013/0247437 | A1 | 9/2013 | Obermeit | |
| 2014/0352189 | A1* | 12/2014 | Fitzpatrick | F41A 9/69<br>42/50 |

OTHER PUBLICATIONS

European Patent Office, International Search Report and Written Opinion of the International Searching Authority, dated Sep. 17, 2014, for PCT/US2013/076376.

* cited by examiner

HYBRID MAGAZINE FOR A FIREARM

FIELD OF THE INVENTION

The present invention relates to ammunition magazines for firearms, more particularly a hybrid ammunition magazine for firearms.

BACKGROUND OF THE INVENTION

Firearms magazines have previously been developed that store and feed cartridges of a particular caliber and cartridge length into a firing chamber of a weapon. As cartridges are cycled through a magazine, the cartridges may come into contact with one or more surfaces of the magazine, and thereby dimple or wear those surfaces. Additionally, as the magazine is repeatedly loaded and unloaded from the firearm, the catch-and-release mechanism of the magazine may become worn or damaged. Further, impact forces due to rough handling of the magazine may result in improper functioning thereof. Accordingly, there is a need for a firearms magazine that addresses these problems and overcomes the limitations of the prior art devices.

ASPECTS OF THE INVENTION

Additional aspects of the invention include:

Aspect 1: A magazine for a firearm, the magazine having a magazine front wall, a magazine rear wall that opposes the magazine front wall, a first magazine sidewall that extends between the magazine front wall and the magazine rear wall, and a second magazine sidewall that extends between the magazine front wall and the magazine rear wall and that opposes the first magazine sidewall, the magazine comprising: a housing comprised of a molded or cast material, the molded or cast material having a first stiffness, the housing having a housing front wall, a housing rear wall that opposes the housing front wall, a first housing sidewall that extends between the housing front wall and the housing rear wall, and a second housing sidewall that extends between the housing front wall and the housing rear wall and that opposes the first housing sidewall, the housing front wall forming at least a portion of the magazine front wall, the housing rear wall forming at least a portion of the magazine rear wall, the first housing sidewall forming at least a portion of the first magazine side wall, and the second housing sidewall forming at least a portion of the second magazine sidewall; a support guard comprised of a material having a second stiffness, wherein at least a portion of the support guard is embedded in the housing and forms a portion of the magazine front wall; and a feed lip assembly that is comprised of a material having a third stiffness, the feed lip assembly being attached to the support guard; wherein the second stiffness and the third stiffness are greater than the first stiffness.

Aspect 2: The magazine according to Aspect 1, wherein the housing is comprised of a polymer.

Aspect 3: The magazine according to either of Aspect 1 or Aspect 2, wherein the support guard and feed lip assembly are comprised of metal.

Aspect 4: The magazine according to any of Aspects 1-3, wherein the feed lip assembly is located external to the housing.

Aspect 5: The magazine according to any of Aspects 1-4, wherein the feed lip assembly is attached to the support guard on at least one of the first magazine sidewall and the second magazine sidewall.

Aspect 6: The magazine according to any of Aspects 1-5, wherein the feed lip assembly is attached to the support guard on both of the first magazine sidewall and the second magazine sidewall.

Aspect 7: The magazine according to any of Aspects 1-6, wherein the feed lip assembly is welded to the support guard.

Aspect 8: The magazine according to any of Aspects 1-7, wherein the feed lip assembly further comprises a magazine catch assembly that operably enables the magazine to be releasably connected to the firearm.

Aspect 9: The magazine according to Aspect 8, wherein the magazine catch assembly is located on one of the first magazine sidewall and the second magazine sidewall.

Aspect 10: The magazine according to any of Aspects 1-9, wherein the feed lip assembly forms at least a portion of at least one of the first magazine sidewall and the second magazine sidewall.

Aspect 11: The magazine according to any of Aspects 1-10, wherein the housing is transparent.

Aspect 12: The magazine according to any of Aspects 1-11, wherein the housing is translucent.

Aspect 13: The magazine according to any of Aspects 1-12, wherein the support guard is approximately "U"-shaped in cross section.

Aspect 14: The magazine according to any of Aspects 1-13, wherein the support guard has a first portion that forms at least a portion of an exterior surface of the magazine front wall and a second portion that is embedded in at least a portion of the housing front wall, such that the second portion does not form a part of an exterior surface of the magazine front wall.

Aspect 15: The magazine according to Aspect 14, wherein the first portion forms at least a portion of an interior surface of the magazine front wall.

Aspect 16: The magazine according to Aspect 14, wherein the second portion does not form a portion of an interior surface of the magazine front wall.

Aspect 17: The magazine according to Aspect 14, wherein the support guard has at least one side portion that is embedded in at least a portion of the first housing sidewall or second housing sidewall.

Aspect 18: The magazine according to Aspect 17, wherein the at least one side portion is exposed only where it is overlapped by the feed lip assembly.

Aspect 19: The magazine according to Aspect 17, wherein the at least one side portion forms a portion of the first magazine sidewall or second magazine sidewall and is in contact with and overlapped by a portion of the feed lip assembly.

Aspect 20: The magazine according to any of Aspects 1-19, wherein the support guard has an exposed portion that forms at least a portion of the exterior surface of the magazine front wall, at least a portion of the exposed portion comprises a first planar surface, at least a portion of the exterior surface of the housing front wall comprises a second planar surface, and the first planar surface and the second planar surface are parallel.

Aspect 21: The magazine according to any of Aspects 1-20, wherein no portion of the support guard forms any portion of an exterior surface of the magazine front wall.

Aspect 22: A method of constructing a magazine for a firearm, the magazine having a magazine front wall, a magazine rear wall that opposes the magazine front wall, a first magazine sidewall that extends between the magazine front wall and the magazine rear wall, and a second magazine sidewall that that extends between the magazine front wall and the magazine rear wall and that opposes the first magazine sidewall, the method comprising: embedding a support guard at least partially into a housing, the housing having a housing front wall, a housing rear wall that opposes the housing front wall, a first housing sidewall that extends between the housing front wall and the housing rear wall, and a second housing sidewall that extends between the housing front wall and the housing rear wall and that opposes the first housing sidewall, the housing front wall forming at least a portion of the magazine front wall, the housing rear wall forming at least a portion of the magazine rear wall, the first housing sidewall forming at least a portion of the first magazine side wall, and the second housing sidewall forming at least a portion of the second magazine sidewall; and attaching a feed lip assembly to the support guard through at least one of the first housing sidewall and the second housing sidewall.

Aspect 23: The method according to Aspect 22, wherein the embedding step comprises casting or molding the housing with the support guard at least partially embedded in the housing.

Aspect 24: The method according to either of Aspect 22 or Aspect 23, wherein the attaching step further comprises welding the feed lip assembly to the support guard.

Aspect 25: The method according to any of Aspects 22-24, wherein the embedding step further comprises forming the housing out of a material having a first stiffness, wherein the support guard is comprised of a material having a second stiffness, wherein the second stiffness is greater than the first stiffness.

Aspect 26: The method according to any of Aspects 22-25, wherein the embedding step further comprises forming the housing out of a polymeric material, wherein the support guard is comprised of metal.

Aspect 27: The method according to any of Aspects 22-26, wherein the step of attaching the feed lip assembly to the support guard comprises attaching a feed lip assembly comprised of metal to the support guard.

Aspect 28: The method according to any of Aspects 22-27, further comprising forming a magazine catch assembly in the feed lip assembly, the magazine catch assembly enabling the magazine to be releasably connected to the firearm.

Aspect 29: The method according to any of Aspects 22-28, further comprising molding the housing such that it is transparent or translucent.

Aspect 30: The method according to any of Aspects 22-29, wherein the embedding step further comprises locating the support guard such that it has a first portion that forms at least a portion of an exterior surface of the magazine front wall and a second portion that is formed within at least a portion of the housing front wall, such that the second portion does not form a part of an exterior surface of the magazine front wall.

Aspect 31: A magazine for a firearm, the magazine having a magazine front wall, a magazine rear wall that opposes the magazine front wall, a first magazine sidewall that extends between the magazine front wall and the magazine rear wall, and a second magazine sidewall that extends between the magazine front wall and the magazine rear wall and that opposes the first magazine sidewall, the magazine comprising: a housing comprised of a polymer material, the housing having a housing front wall, a housing rear wall that opposes the housing front wall, a first housing sidewall that extends between the housing front wall and the housing rear wall, and a second housing sidewall that extends between the housing front wall and the housing rear wall and that opposes the first housing sidewall, the housing front wall forming at least a portion of the magazine front wall, the housing rear wall forming at least a portion of the magazine rear wall, the first housing sidewall forming at least a portion of the first magazine side wall, and the second housing sidewall forming at least a portion of the second magazine sidewall; and a combined support guard and feed lip assembly, the combined support guard and feed lip assembly being comprised of a material having greater stiffness than the polymer material that comprises the housing, the combined support guard and feed lip assembly being approximately rectangular in cross-section, wherein at least a portion of the combined support guard and feed lip assembly is embedded in the housing and forms a portion of the magazine front wall.

Aspect 32: The magazine according to Aspect 31, wherein the combined support guard and feed lip assembly are comprised of metal.

Aspect 33: A magazine for a firearm, the magazine having a magazine front wall, a magazine rear wall that opposes the magazine front wall, a first magazine sidewall that extends between the magazine front wall and the magazine rear wall, and a second magazine sidewall that extends between the magazine front wall and the magazine rear wall and that opposes the first magazine sidewall, the magazine comprising: a housing comprised of a polymer material, the housing having a housing front wall, a housing rear wall that opposes the housing front wall, a first housing sidewall that extends between the housing front wall and the housing rear wall, and a second housing sidewall that extends between the housing front wall and the housing rear wall and that opposes the first housing sidewall, the housing front wall forming at least a portion of the magazine front wall, the housing rear wall forming at least a portion of the magazine rear wall, the first housing sidewall forming at least a portion of the first magazine side wall, and the second housing sidewall forming at least a portion of the second magazine sidewall; and a combined support guard and feed lip assembly, the combined support guard and feed lip assembly being comprised of a material having greater stiffness than the polymer material that comprises the housing, the combined support guard and feed lip assembly being approximately rectangular in cross-section, wherein at least a portion of the combined support guard and feed lip assembly is embedded in the housing and forms a portion of the magazine front wall.

Aspect 34: A magazine for a firearm, the magazine having a magazine front wall, a magazine rear wall that opposes the magazine front wall, a first magazine sidewall that extends between the magazine front wall and the magazine rear wall, and a second magazine sidewall that extends between the magazine front wall and the magazine rear wall and that opposes the first magazine sidewall, the magazine comprising: a housing comprised of a polymer material, the housing having a housing front wall, a housing rear wall that opposes the housing front wall, a first housing sidewall that extends between the housing front wall and the housing rear wall, and a second housing sidewall that extends between the housing front wall and the housing rear wall and that opposes the first housing sidewall, the housing front wall forming at least a portion of the magazine front wall, the housing rear wall forming at least a portion of the magazine rear wall, the first housing sidewall forming at least a portion of the first magazine side wall, and the second housing sidewall forming at least a portion of the second magazine sidewall; and a combined support guard and feed lip assembly that is comprised of metal, the combined support guard and feed lip assembly being approximately rectangular in cross-section, wherein at least a portion of the combined support guard and feed lip assembly is embedded in the housing and forms a portion of the magazine front wall.

Aspect 35: A magazine for a firearm, the magazine having a magazine front wall, a magazine rear wall that opposes the magazine front wall, a first magazine sidewall that extends between the magazine front wall and the magazine rear wall, and a second magazine sidewall that extends between the magazine front wall and the magazine rear wall and that opposes the first magazine sidewall, the magazine comprising: a housing comprised of a molded or cast material, the housing having a housing front wall, a housing rear wall that opposes the housing front wall, a first housing sidewall that extends between the housing front wall and the housing rear wall, and a second housing sidewall that extends between the housing front wall and the housing rear wall and that opposes the first housing sidewall, the housing front wall forming at least a portion of the magazine front wall, the housing rear wall forming at least a portion of the magazine rear wall, the first housing sidewall forming at least a portion of the first magazine side wall, and the second housing sidewall forming at least a portion of the second magazine sidewall;

a support guard comprised of metal, wherein at least a portion of the support guard is embedded in the housing and forms a portion of the magazine front wall; and a feed lip assembly comprised of metal, the feed lip assembly being attached to the support guard.

Aspect 36: The magazine according to Aspect 35, wherein the housing is comprised of a polymer.

BRIEF DESCRIPTION OF THE DRAWINGS

The foregoing summary, as well as the following detailed description of the invention, will be better understood when read in conjunction with the appended drawings. For the purpose of illustrating the invention disclosed herein, certain embodiments in accordance with the herein disclosed invention are shown in the drawings. It should be understood, however, that the herein disclosed invention is not limited to the precise arrangements shown. It should also be understood that, in the drawings, the parts are not necessarily drawn to scale. The present invention will hereinafter be described in conjunction with the appended drawing figures, wherein like numerals denote like elements. In the drawings.

DETAILED DESCRIPTION OF THE PREFERRED EMBODIMENTS

Figure 1:
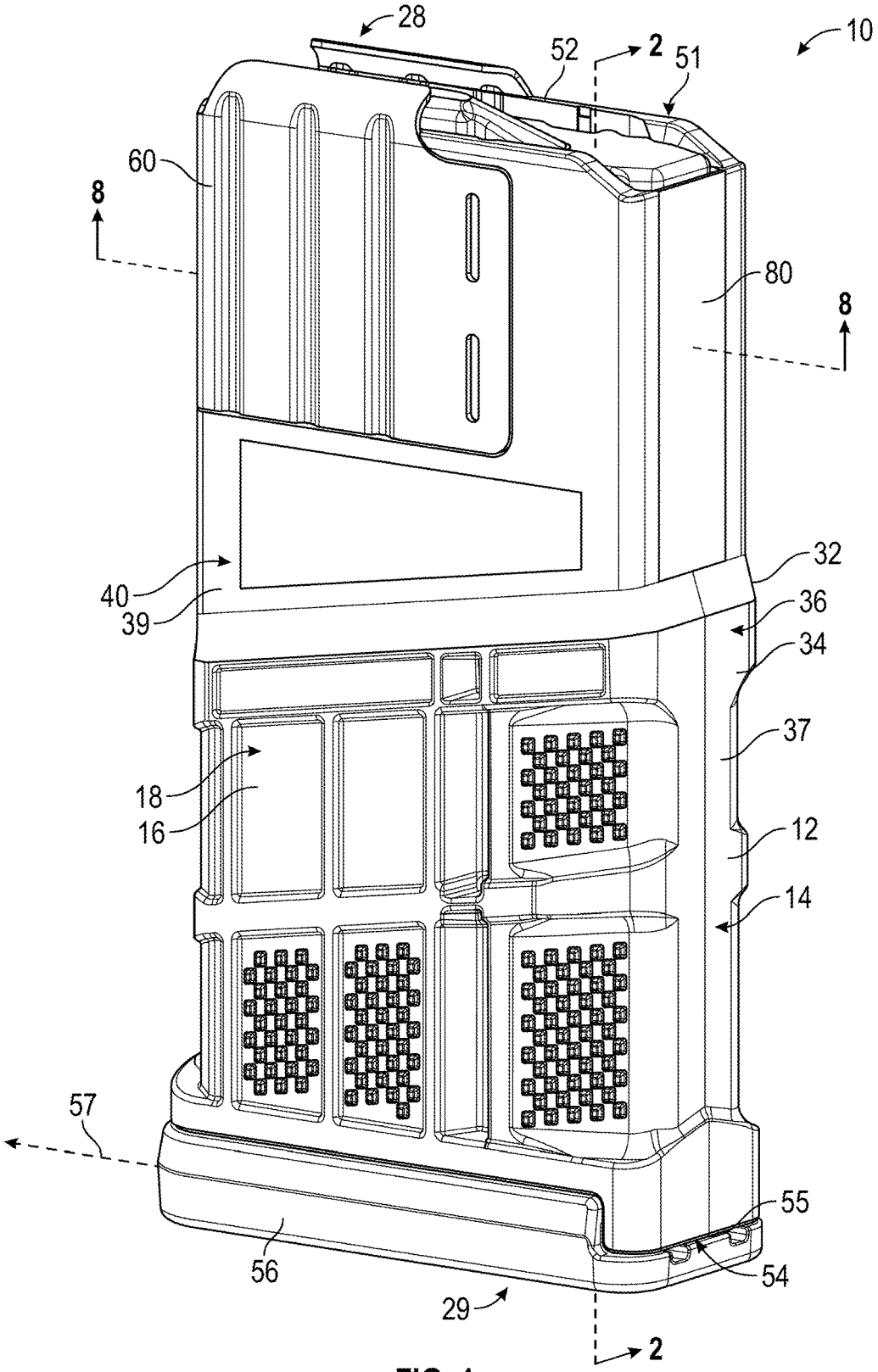
FIG. 1 is a perspective view of a magazine according to the present invention.

The ensuing detailed description provides preferred exemplary embodiments only, and is not intended to limit the scope, applicability, or configuration of the herein disclosed inventions. Rather, the ensuing detailed description of the preferred exemplary embodiments will provide those skilled in the art with an enabling description for implementing the preferred exemplary embodiments in accordance with the herein disclosed invention. It should be understood that various changes may be made in the function and arrangement of elements without departing from the spirit and scope of the invention, as set forth in the appended claims.

To aid in describing the invention, directional terms may be used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

For purposes of this specification and the appended claims, a first part is "embedded" in a second part when at least a portion of the first part is at least partially enveloped, enclosed, incorporated into, or contained within at least a portion of the second part.

For purposes of this specification and the appended claims, the "stiffness" of a material refers to its Young's Modulus. Said another way, a first material is stiffer than a second material where the Young's Modulus of the first material is greater than the Young's Modulus of the second material.

Referring generally to FIGS. 1-8, one embodiment of a magazine 10 for a firearm according to the present invention will be described in detail. In this embodiment, the magazine 10 is designed to accommodate rifle-length cartridges, for example 7.62×51 mm NATO cartridges. It should be understood that both the cross-sectional shape and longitudinal shape of the magazine 10 are largely dictated by the shape of the cartridges that the magazine 10 is designed to accommodate. Accordingly, other embodiments of the magazine 10 may have a different cross-sectional shape and/or longitudinal shape.

In this embodiment, the magazine 10 has a front wall 12 having an exterior surface 14 and an interior surface 15, an opposing rear wall 24 having an exterior surface 26 and an interior surface 27, a first sidewall 16 having an exterior surface 18 and an interior surface 19, and an opposing second sidewall 20 having an exterior surface 22 and an interior surface 23. The first sidewall 16 and second sidewall 20 of the magazine 10 extend between the front wall 12 and the rear wall 24 thereof. The magazine 10 further includes a top side 28 that corresponds with the uppermost end of the magazine 10 and a bottom side 29 that corresponds with the lowermost end of the magazine 10 (which, in this embodiment, is defined by the bottom cover 56, as further described below). In this embodiment, the magazine 10 is approximately rectangular in cross-section, with the front wall 12 and rear wall 24 forming the opposing shorter sides of the rectangular cross-sectional shape and the first sidewall 16 and second sidewall 20 forming the opposing longer sides of the rectangular cross-sectional shape. It should be understood that, in alternate embodiments, the magazine 10 can be of any other cross-sectional and/or longitudinal shape, and could have greater or less than four walls.

The magazine 10 comprises a housing 32, which in this embodiment has a front wall 34 having an exterior surface 36 and an interior surface 38, an opposing rear wall 46 having an exterior surface 48 and an interior surface 49, a first sidewall 39 having an exterior surface 40 and an interior surface 41, and an opposing second sidewall 42 having an exterior surface 44 and an interior surface 45. The first sidewall 39 and second sidewall 42 of the housing 32 extend between the front wall 34 and the rear wall 46 thereof. In this embodiment, the exterior surface 36 of the front wall 34 of the housing 32 comprises a planar surface 37. The housing further includes a top side 51 defined by an opening 52 and a bottom side 54 defined by an opening 55. As noted above, a bottom cover 56 is attached to the bottom side 54 of the housing 32. When installed over the bottom side 54 of the housing 32, the bottom cover 56 conceals the opening 55 and forms the bottom side 29 of the magazine 10. The bottom cover 56 is removable from the housing 32 by being slid in the removal direction 57, and installable onto the housing 32 by being slid in a direction opposite the removal direction 57.

In this embodiment, the front wall 34 of the housing 32 corresponds with a portion of the front wall 12 of the magazine 10, the rear wall 46 of the housing 32 corresponds with a portion of the rear wall 24 of the magazine 10, the first sidewall 39 of the housing 32 corresponds with a portion of the first sidewall 16 of the magazine 10, and the second sidewall 42 of the housing 32 corresponds with a portion of the second sidewall 20 of the magazine 10.

In this embodiment, the housing 32 is comprised of a thermoplastic. In various embodiments according to the present invention, the housing 32 may be comprised of any natural polymeric material or synthetic polymer material, for example thermoplastics, thermosets, or single- or two-part polymers, cast materials, polyurethanes, nylon, resins, silicone, ceramics, or any suitable composite material such as fiber-reinforced polymers. As noted above, in this embodiment the housing 32 is transparent. In alternate embodiments, the housing 32 may be translucent. In further alternate embodiments, the housing 32 may be opaque.

Figure 2:
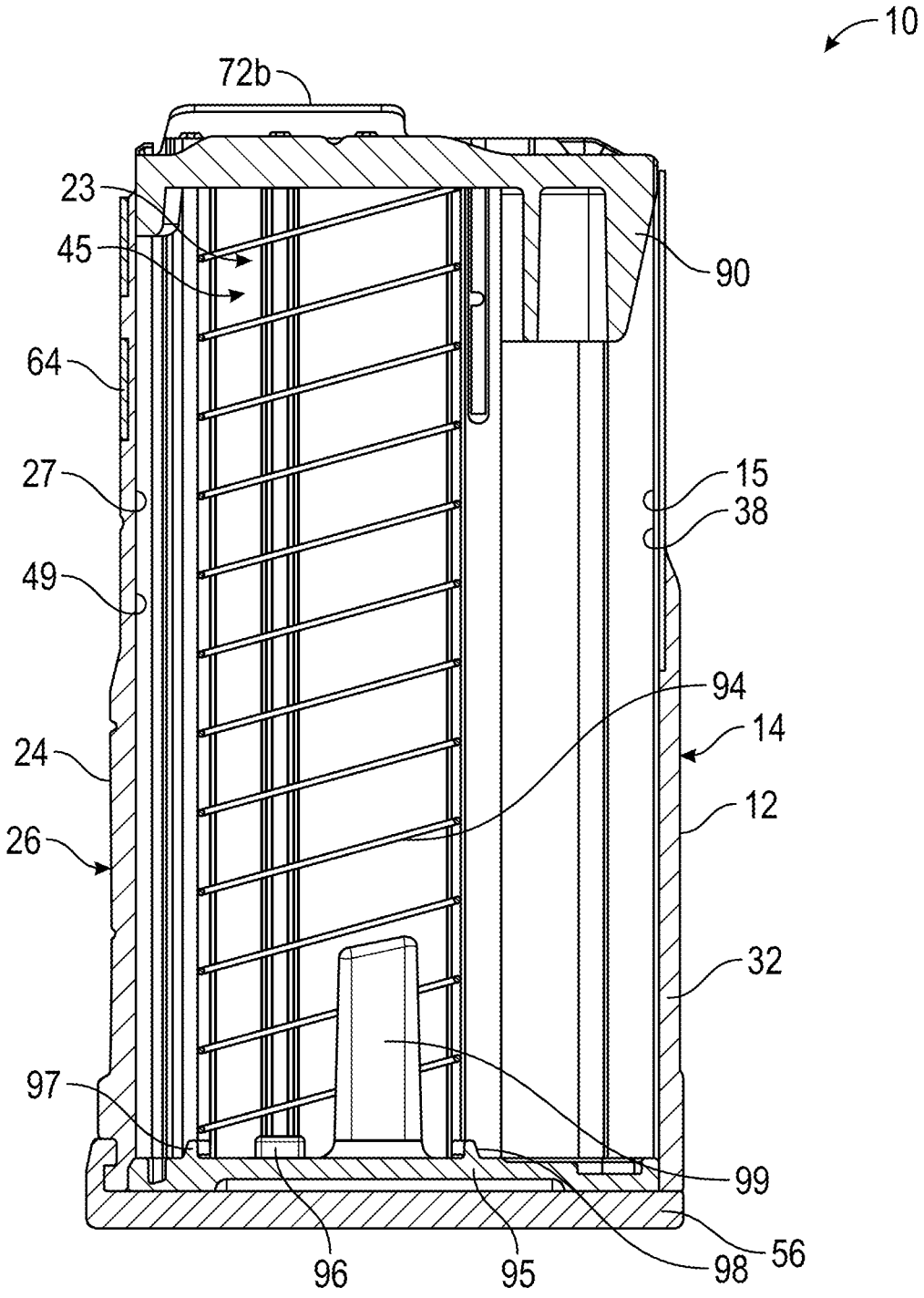
FIG. 2 is a sectional view taken along line 2-2 of FIG. 1.

FIG. 2 shows a sectional view of the magazine 10 taken along line 2-2 of FIG. 1. In this figure, the interior of the magazine 10 can be seen. As will be described in further detail below, a spring 94 located within the magazine 10 biases a cartridge loading and deployment assembly, or follower 90, towards the top side 28 of the magazine 10. The top end of the spring 94 makes contact with the bottom side of the follower 90 and is held in place by a spring retainer 93 that is built into the bottom side of the follower 90 (see FIG. 8), and the bottom end of the spring 94 makes contact with a base plate 95 which is located within the opening 55 located in the bottom side 54 of the housing 32. The base plate 95 includes spring retainer 96 (an additional spring retainer that is identical to spring retainer 96 is located opposite spring retainer 96 on the base plate 95, but is not shown or labeled in the figures), spring retainers 97,98, and spring alignment guide 99 that support the bottom end of the spring 94 and maintain the spring 94 in proper alignment within the housing 32. The bottom cover 56 retains the base plate 95 and spring 94 within the housing 32. When the spring 94 is installed within the magazine 10, it is placed in a compressed state, which urges the follower 90 towards the top side 28 of the magazine 10. Thus, when one or more cartridges are stored within the magazine 10 on top of the follower 90, the cartridge is biased upwardly via the operation of the spring 94 and follower 90. In alternate embodiments, one or more of the spring retainers 93,96,97,98 may be omitted.

Figure 3:
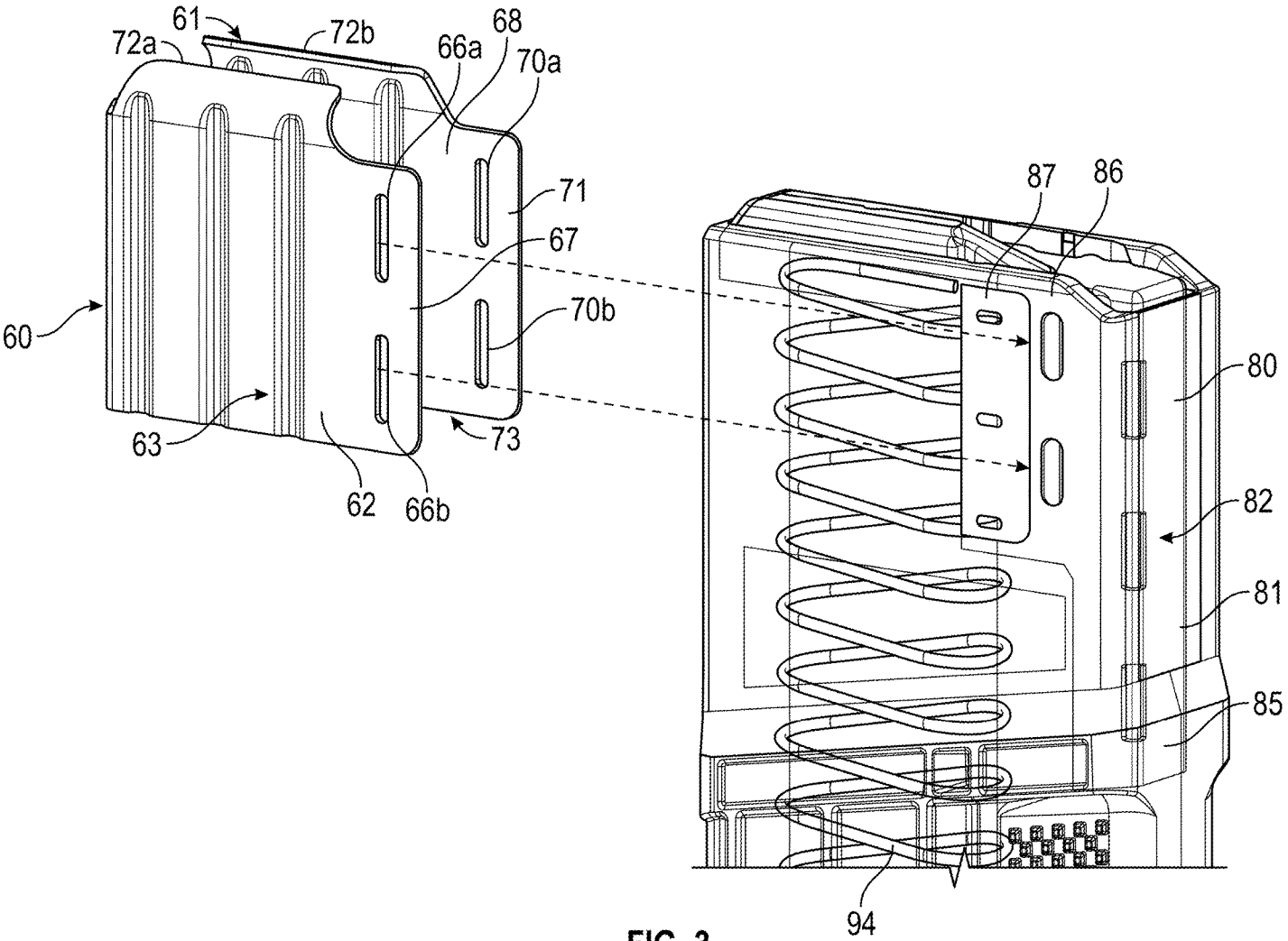
FIG. 3 is a partial exploded view, showing how a feed lip assembly is attached and secured to a support guard of the magazine according to the present invention.
Figure 4:
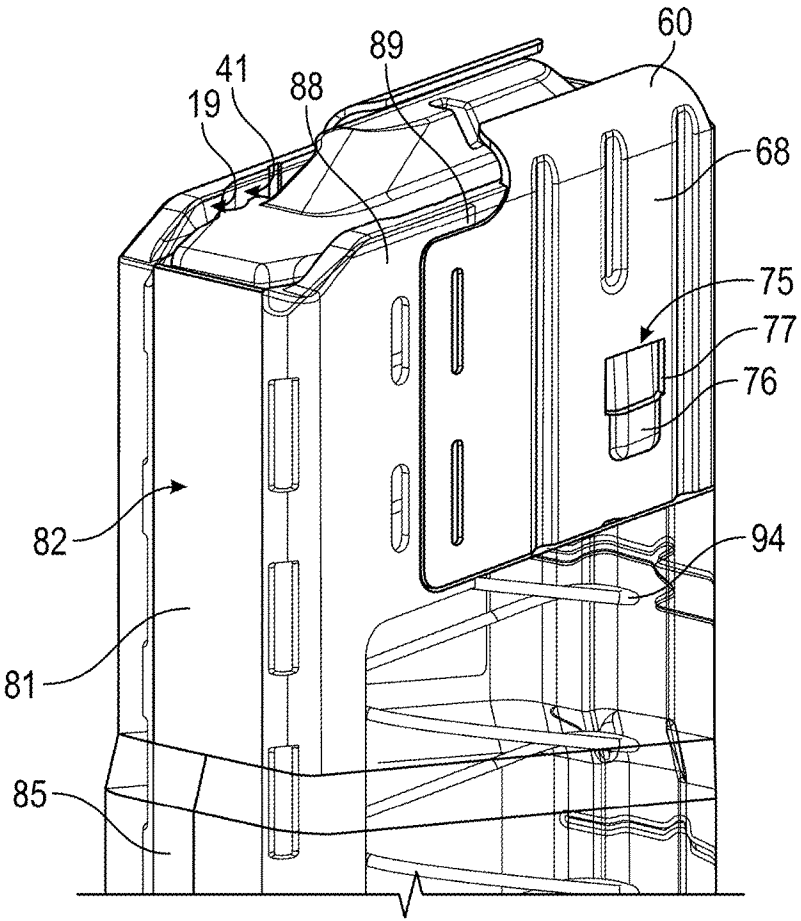

FIGS. 3-8 show various views of one embodiment of a feed lip assembly 60 and support guard 80 according to the present invention. In FIGS. 3 and 4, the housing 32 is shown transparent so that parts located internal to the magazine 10 may be more easily illustrated. The housing 32 of the magazine 10 is preferably transparent or translucent so that the operator can quickly determine how many cartridges are loaded within the magazine 10 and whether any foreign objects, such as dirt, sand, or water, have found their way into the magazine 10. In alternate embodiments, the magazine 10 may be opaque. In some embodiments according to the present invention, the feed lip assembly 60 and support guard 80 have a greater stiffness, i.e., a greater Young's Modulus, than the material that comprises the housing 32.

Returning to FIGS. 3-8, in this embodiment the support guard 80 is embedded in the housing 32. The support guard 80 comprises a front portion 81, a first side portion 86 that extends from the front portion 81, and a second side portion 88 that is located opposite the first side portion 86 and also extends from the front portion 81, so that the support guard 80 is approximately "U"-shaped in cross-section. In this embodiment, the front portion 81 of the support guard 80 has a first or exposed portion 82 and a second or unexposed portion 85. The exposed portion 82 of the front portion 81 of the support guard 80 includes a planar surface 83. In this embodiment, the planar surface 83 of the exposed portion 82 of the support guard 80 is parallel with the planar surface 37 of the exterior surface 36 of the front wall 34 of the housing 32. In this embodiment, the support guard 80 has been embedded in the housing 32 such that the exposed portion 82 of the front portion 81 forms a portion of the exterior surface 14 of the front wall 12 of the magazine 10, the interior surface 84 of the front portion 81 forms a portion of the interior surface 15 of the front wall 12 of the magazine 10, and the unexposed portion 85 of the front portion 81 of the support guard 80 is embedded in a portion of the front wall 34 of the housing 32, such that the unexposed portion 85 does not form a part of the exterior surface 14 of the front wall 12 of the magazine 10. The strength of the exposed portion 82 of the front portion 81 of the support guard 80 maximizes the durability of the magazine 10, since the exposed portion 82 will come into repeated contact with portions of the firearm to which the magazine 10 is attached. In addition, the strength of the interior surface 84 of the front portion 81 of the support guard 80 protects the magazine 10 from damage as cartridges are cycled through the magazine 10.

In this embodiment, the first side portion 86 of the support guard 80 is embedded in the first sidewall 39 of the housing 32, only forms a portion of the exterior surface 40 of the first sidewall 39 of the housing 32 at an attachment portion 87 (i.e., that portion of the first side portion 86 of the support guard 80 that is overlapped by the feed lip assembly 60), and forms no part of the interior surface 41 of the first sidewall 39 of the housing 32. In alternate embodiments, additional portions or no portion of the first side portion 86 of the support guard 80 may form a part of the exterior surface 40 of the first sidewall 39 of the housing 32 and/or at least a portion of the first side portion 86 of the support guard 80 may form a part of the interior surface 41 of the first sidewall 39 of the housing 32. In this embodiment, the second side portion 88 of the support guard 80 is embedded in the second sidewall 42 of the housing 32, only forms a portion of the exterior surface 44 of the second sidewall 42 of the housing 32 at an attachment portion 89 (i.e., that portion of the second side portion 88 of the support guard 80 that is overlapped by the feed lip assembly 60), and forms no part of the interior surface 45 of the second sidewall 42 of the housing 32. In alternate embodiments, additional portions or no portion of the second side portion 88 of the support guard 80 may form a part of the exterior surface 44 of the second sidewall 42 of the housing 32 and/or at least a portion of the second side portion 88 of the support guard 80 may form a part of the interior surface 45 of the second sidewall 42 of the housing 32. In this embodiment, the attachment portions 87,89 are shaped and sized in order to accommodate placement of attachment portions 67,71 of the feed lip assembly 60 therein (see FIG. 3) so that the attachment portions 67,71 of the feed lip assembly 60 can form portions, respectively, of the exterior surfaces 18,22 of the first and second sidewalls 16,20 of the magazine 10.

The support guard 80 may be embedded in the housing 32 via any known casting or molding technique. The support guard 80 may be supported in place via one or more standoff pins before the material that comprises the housing 32 is poured around the support guard 80.

The feed lip assembly 60 comprises a front opening 73, a rear portion 64 having an exterior surface 65 and being located opposite the front opening 73, a first side portion 62 that extends from the rear portion 64 and has an exterior surface 63, and a second side portion 68 that extends from the rear portion 64, has an exterior surface 65, and is located opposite the first side portion 62. As such, the feed lip assembly 60 is approximately "U"-shaped in cross-section. The first side portion 62 of the feed lip assembly 60 comprises an attachment portion 67 that includes a pair of slots 66*a*,66*b* through which the first side portion 62 of the feed lip assembly 60 is attached to the attachment portion 87 of the first side portion 86 of the support guard 80, and the second side portion 68 of the feed lip assembly 60 comprises an attachment portion 71 that includes a pair of slots 70*a*,70*b* through which the second side portion 68 of the feed lip assembly 60 is attached to the attachment portion 89 of the second side portion 88 of the support guard 80. In this way, the feed lip assembly 60 is located external to the housing 32, the first side portion 62 of the feed lip assembly 60 forms a portion of the first sidewall 16 of the magazine 10, the second side portion 68 of the feed lip assembly 60 forms a portion of the second sidewall 20 of the magazine 10, and the rear portion 64 of the feed lip assembly 60 forms a portion of the rear wall 24 of the magazine 10. Maintaining the feed lip assembly 60 as a separable part, such that it is not embedded within the housing 32, allows for greater manufacturability of the housing 32 from the polymeric material, prior to the feed lip assembly 60 being attached to the support guard 80 to form the magazine 10.

In this embodiment, the feed lip assembly 60 is attached to the support guard 80 at the slots 66*a*,66*b*,70*a*,70*b* via laser welding. In alternate embodiments, the feed lip assembly 60 can be attached to the support guard 80 via other means, such as through the use of adhesives, fasteners, other welding techniques, or swaging. In further alternate embodiments, the feed lip assembly 60 can be attached to the support guard 80 at fewer, greater, or different locations than the slots 66*a*,66*b*,70*a*,70*b*, and/or the feed lip assembly 60 could be attached to the support guard 80 on only one side of the magazine 10.

Figure 5:
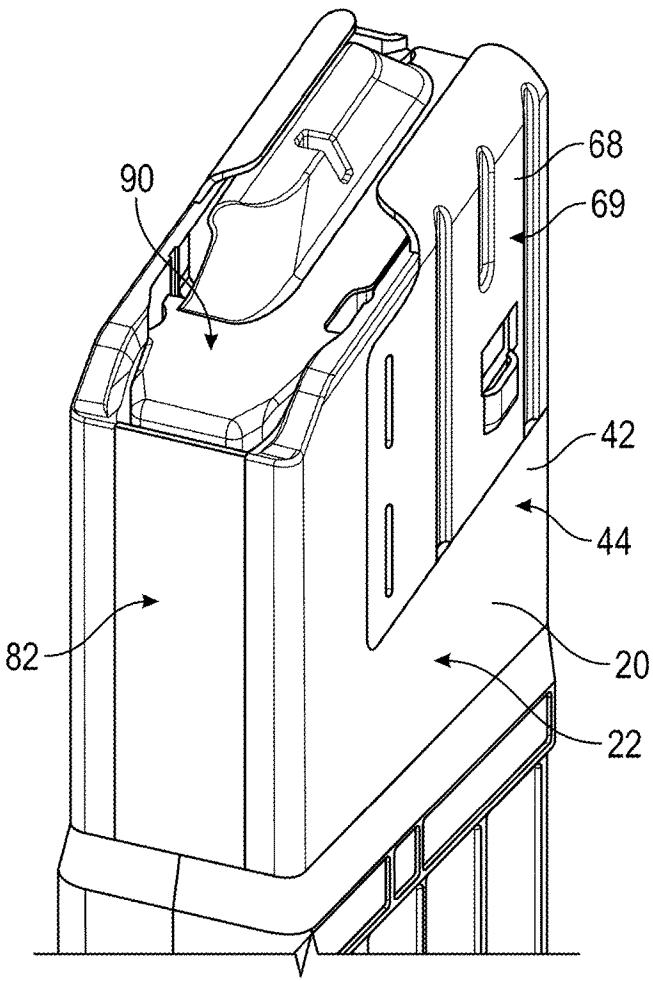
FIGS. 4 and 5 are partial front perspective views of the magazine of FIG. 1.
Figure 6:
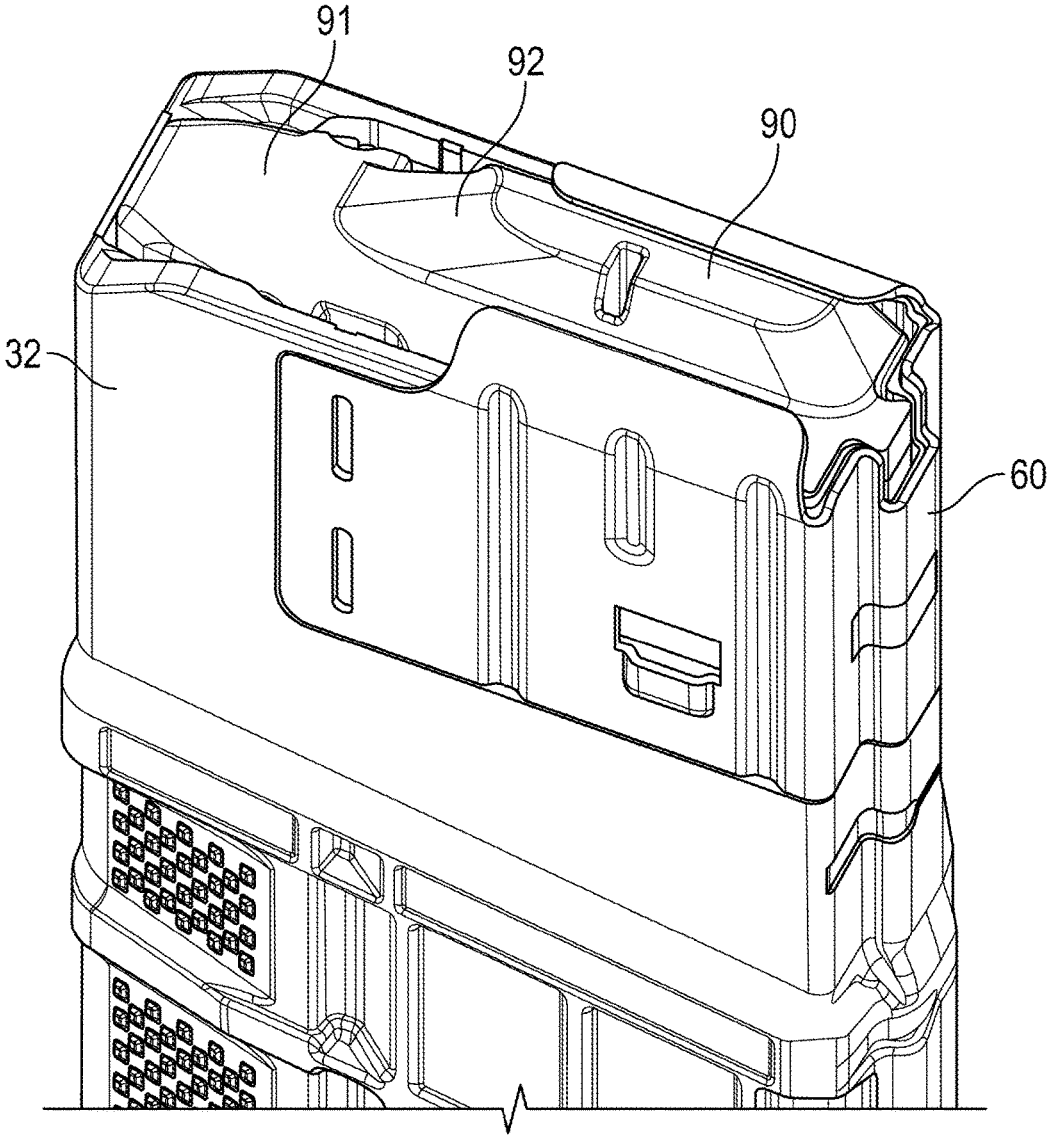
FIG. 6 is a partial rear perspective view thereof.
Figure 7:
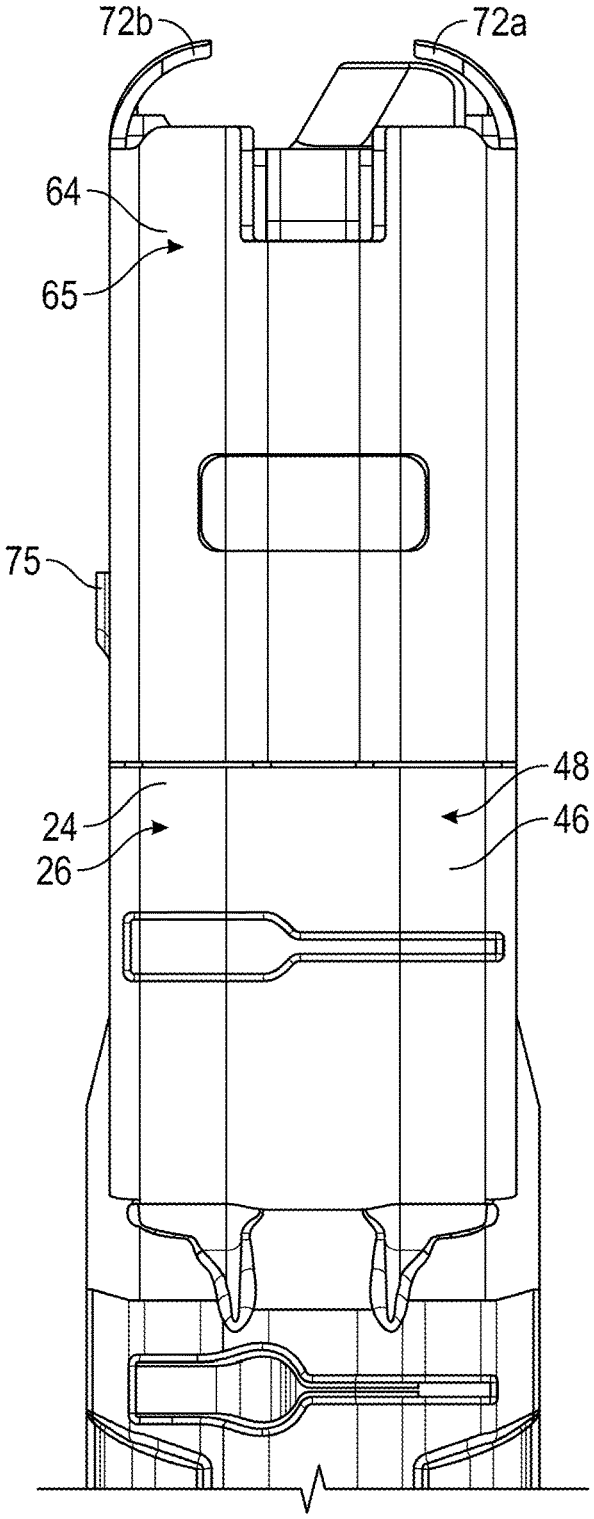
FIG. 7 is a partial rear view thereof.
Figure 8:
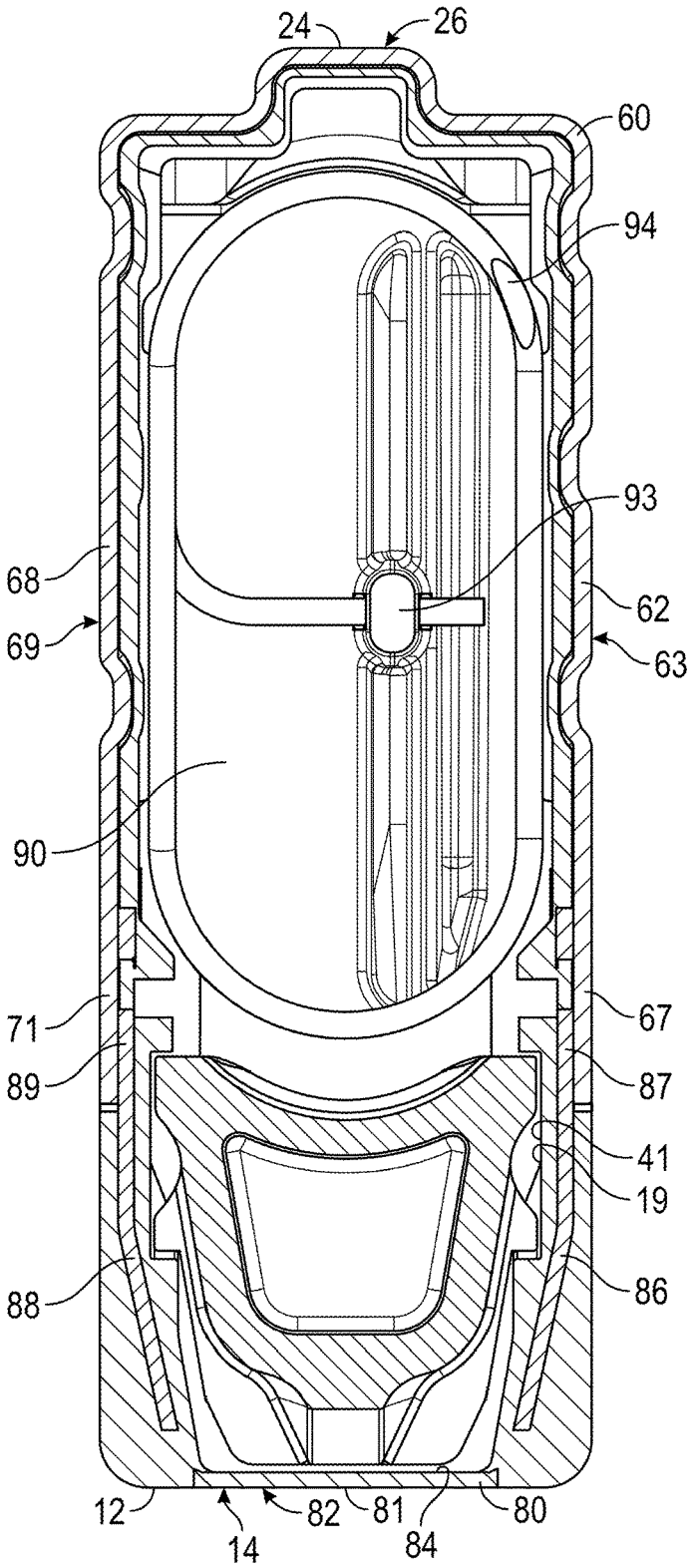
FIG. 8 is a sectional view taken along line 8-8 of FIG. 1.

Located at a top end 61 of the feed lip assembly 60 are a pair of feed lips 72*a*,72*b* which are approximately arcuate in cross-section and act to support and assist both the loading of cartridges into the magazine 10 and the feeding of cartridges out of the magazine 10 into the firing chamber of a firearm. As best seen in FIGS. 5-7, the follower 90 has a flat portion 91 and a ramped portion 92 thereon. The flat portion 91 and ramped portion 92 of the follower 90 ensure that the cartridges are properly stacked within the magazine 10 when it is loaded and also ensure that the cartridges are properly fed, one-at-a-time, into the firing chamber of a firearm when the firearm is being used.

In this embodiment, both the feed lip assembly 60 and the support guard 80 are comprised of metal, for example steel. A magazine catch assembly 75, which operably enables the magazine 10 to be releasably connected to the firearm, is built into the second side portion 68 of the feed lip assembly 60 such that the magazine catch assembly 75 forms part of the second sidewall 20 of the magazine 10. The magazine catch assembly 75 comprises a ramped portion 76 and an indented portion 77. When the magazine 10 is inserted into the firearm, a releasable catch within the firearm will ride up the ramped portion 76 and engage the indented portion 77 so that the magazine 10 cannot be removed from the firearm unless a catch release on the firearm is actuated, thereby disengaging the releasable catch of the firearm from the indented portion 77. In alternate embodiments, the magazine catch assembly 75 need not be formed in the feed lip assembly 60, and could instead be formed into the second sidewall 42 of the housing 32. Further, the magazine catch assembly 75 could be located elsewhere on the magazine 10 or there could be more than one magazine catch assembly located on the magazine 10 (including the front wall 34 or rear wall 46 of the housing 32), depending on the design of the firearm with which the magazine 10 is designed to be used.

Forming the feed lip assembly 60 (including the magazine catch assembly 75) and support guard 80 out of metal, and attaching these parts together, gives the magazine 10 greater strength and durability in the portions of the magazine 10 that will be engaged within the firearm. The attachment between the cross-sectional "U"-shaped feed lip assembly 60 and cross-sectional "U"-shaped support guard 80 renders the magazine 10 with the strength of a "full box" (i.e., rectangular around its full perimeter) metal construction. Forming the remainder of the magazine 10 (i.e., approximately that portion of the magazine 10 that is not engaged within the firearm) out of a polymeric material gives the magazine 10 greater strength in said portion and permits the magazine 10 to be of reduced weight and transparent. In alternate embodiments, the feed lip assembly 60 and support guard 80 could be formed together as a single metal piece having a rectangular shape in cross section (i.e., a "full box" construction), and then embedded within one or more of the walls 34,39,42,46 of the polymeric housing 32 according to the present invention such that at least a portion of the combined feed lip assembly and support guard is embedded in the housing and forms a portion of the magazine front wall.

It should be appreciated that the foregoing is presented by way of illustration only, and not by way of any limitation, and that various alternatives and modifications may be made to the illustrated embodiments without departing from the spirit and scope of the present invention.

The invention claimed is:

1. A magazine for a firearm, the magazine having a magazine front wall, a magazine rear wall that opposes the magazine front wall, a first magazine sidewall that extends between the magazine front wall and the magazine rear wall, and a second magazine sidewall that extends between the magazine front wall and the magazine rear wall and that opposes the first magazine sidewall, the magazine comprising:

a housing comprised of a molded or cast material, the molded or cast material having a first stiffness, the housing having a housing front wall, a housing rear wall that opposes the housing front wall, a first housing sidewall that extends between the housing front wall and the housing rear wall, and a second housing sidewall that extends between the housing front wall and the housing rear wall and that opposes the first housing sidewall, the housing front wall forming at least a portion of the magazine front wall, the housing rear wall forming at least a portion of the magazine rear wall, the first housing sidewall forming at least a portion of the first magazine side wall, and the second housing sidewall forming at least a portion of the second magazine sidewall;

a support guard comprised of a material having a second stiffness, the support guard including a support guard front wall, a first support guard side portion that extends from the support guard front wall to a first support guard side end, and a second support guard side portion that extends from the support guard front wall to a second support guard side end, wherein at least a portion of the support guard front wall is embedded in the housing and forms a portion of the magazine front wall, the first support guard side portion is embedded in the first housing sidewall and forms a portion of the first magazine sidewall, the second support guard side portion is embedded in the second housing sidewall and forms a portion of the second magazine side wall, the first support guard side portion forms no portion of an interior surface of the first magazine sidewall, and the second support guard side portion forms no portion of an interior surface of the second magazine sidewall; and a feed lip assembly that is comprised of a material having a third stiffness, the feed lip assembly being attached to the support guard and disposed on an exterior surface of the housing;

wherein the second stiffness and the third stiffness are greater than the first stiffness.

2. The magazine of claim 1, wherein the housing is comprised of a polymer.

3. The magazine of claim 1, wherein the support guard and feed lip assembly are comprised of metal.

4. The magazine of claim 1, wherein the feed lip assembly is attached to the support guard on at least one of the first magazine sidewall and the second magazine sidewall.

5. The magazine of claim 4, wherein the feed lip assembly is attached to the support guard on both of the first magazine sidewall and the second magazine sidewall.

6. The magazine of claim 1, wherein the support guard has a first portion that forms at least a portion of an exterior surface of the magazine front wall and a second portion that is embedded in at least a portion of the housing front wall, such that the second portion does not form a part of an exterior surface of the magazine front wall.

7. The magazine of claim 6, wherein the first portion forms at least a portion of an interior surface of the magazine front wall.

8. The magazine of claim 6, wherein the second portion does not form a portion of an interior surface of the magazine front wall.

9. The magazine of claim 1, wherein the support guard has an exposed portion that forms at least a portion of the exterior surface of the magazine front wall, at least a portion of the exposed portion comprises a first planar surface, at least a portion of the exterior surface of the housing front wall comprises a second planar surface, and the first planar surface and the second planar surface are parallel.

10. The magazine of claim 1, wherein no portion of the support guard forms any portion of an exterior surface of the magazine front wall.

11. The magazine of claim 1, wherein the feed lip assembly includes a first feed lip assembly side portion and a second feed lip assembly side portion, wherein at least a portion of the first feed lip assembly side portion forms a portion of an exterior surface of the first magazine sidewall, and at least a portion of the second feed lip assembly side portion forms a portion of an exterior surface of the second magazine sidewall.

12. The magazine of claim 1, wherein the first support guard side portion is attached to the first feed lip assembly side portion, and the second support guard side portion is attached to the second feed lip assembly side portion.

* * * * *